United States Patent [19]

Ilnyckyj et al.

[11] 3,961,916

[45] June 8, 1976

[54] MIDDLE DISTILLATE COMPOSITIONS WITH IMPROVED FILTERABILITY AND PROCESS THEREFOR

[75] Inventors: Stephen Ilnyckyj, Maplewood, N.J.; Charles O. Cole, Sarnia, Canada

[73] Assignee: Exxon Research and Engineering Company, Linden, N.J.

[22] Filed: Feb. 28, 1974

[21] Appl. No.: 446,596

Related U.S. Application Data

[63] Continuation of Ser. No. 224,612, Feb. 8, 1972, abandoned, which is a continuation-in-part of Ser. No. 115,714, Feb. 16, 1971, abandoned.

[52] U.S. Cl. ..... 44/62; 44/66; 44/70

[51] Int. Cl.[2] ..... C10L 1/18

[58] Field of Search ..... 44/62, 70; 208/28, 33

[56] References Cited

UNITED STATES PATENTS

| | | | |
|---|---|---|---|
| 3,048,479 | 8/1962 | Ilnyckyj et al. | 44/62 |
| 3,275,427 | 9/1966 | Brownawell et al. | 44/62 |
| 3,567,639 | 3/1971 | Aaron et al. | 44/62 |

*Primary Examiner*—Floyd D. Higel
*Assistant Examiner*—Y. Harris-Smith
*Attorney, Agent, or Firm*—David A. Roth; Frank T. Johmann

[57] ABSTRACT

The response of middle distillates to flow improvers can be substantially improved by utilizing a dual-functioning flow improver composition which is a combination of two different wax modifying compounds. One of these functions as a wax growth arrester. The other functions as nucleating agent. Specifically, for example, it has been demonstrated that a copolymer of ethylene with vinyl acetate in combination with another copolymer of ethylene with vinyl acetate where either the vinyl acetate monomer is present in different proportions and/or the molecular weights are different is a flow improver combination which imparts significant improvements in the filterability of middle distillate fuels.

11 Claims, No Drawings

MIDDLE DISTILLATE COMPOSITIONS WITH IMPROVED FILTERABILITY AND PROCESS THEREFOR

RELATED PATENT APPLICATION

This is a continuation of application Ser. No. 224,612 filed Feb. 8, 1972, which in turn is a continuation-in-part of Ser. No. 115,714, filed Feb. 16, 1971, both now abandoned.

Mineral oils containing paraffin wax therein have the characteristic of becoming less fluid as the temperature of the oil decreases. This loss of fluidity is due to the crystallization of the wax into plate-like crystals which eventually form a spongy mass entrapping the oil therein.

It has long been known that various compositions act as wax crystal modifiers when blended with waxy mineral oils. These compositions modify the size and shape of wax crystals and reduce the adhesive forces between the wax and oil in such a manner as to permit the oil to remain fluid at a lower temperature. They are known to the art as "wax modifiers", "pour point depressants", or "flow improvers" in that they lower the temperature at which the oil maintains its free flow characteristics.

Various pour point depressants have been described in the literature and many of these are in commercial use. For example, U.S. Pat. No. 3,048,479 teaches the use of copolymers of ethylene and $C_3$–$C_5$ vinyl esters, e.g., vinyl acetate, as pour depressants for fuels, specifically heating oils, diesel and jet fuels. Hydrocarbon polymeric pour depressants based on ethylene and higher alpha-olefins, e.g. propylene, are also known.

Distillate fuels derived from paraffinic or mixed crude oils and having a boiling range, as determined by ASTM Distillation D-86, of about 350°F. to 700°F. on exposure to ambient winter temperatures in moderate climates, separate wax crystals. Chemically, these crystals are built almost exclusively of n-paraffins. A surprisingly low proportion of solid n-paraffins, such as 0.5% of the bulk oil, is sufficient to congeal the oil and thus render it not pumpable and not filterable.

It has now been found that the low-temperature flow problems encountered in the field which have become a significant characteristic of present day middle distillates can be very satisfactorily controlled and alleviated by the proper choice of a combination of certain wax modifiers. The combination of dual function wax modifiers comprises (a) a nucleating agent or wax growth stimulator and (b) a wax crystal growth arrester.

In accordance with the present invention, a fuel composition is provided which comprises a major proportion, i.e. more than 50% by weight, of a middle distillate petroleum fraction and from about 0.001 to 0.5 wt. % of a flow and filterability improver composition comprising a. 1–20 parts by weight of a synthetic polymeric material having the property of a wax growth stimulator in said distillate, and b. 1–100 parts by weight of a synthetic polymeric material having the property of a wax growth arrester in said distillate; said growth arrester being also a pour depressant.

The wax growth stimulator or nucleator is a synthetic polymeric material which is soluble in the distillate at temperatures substantially above the saturation temperature but on cooling of the distillate progressively separates out in the form of small particles as the temperature of the distillate approaches the saturation point, e.g. is cooled from a point slightly above (e.g. 10°F. above; preferably about 5°F. above) said saturation temperature. The term "saturation temperature" is defined as the lowest temperature at which solute, e.g. wax, cannot be crystallized out of the solution even if known crystallization inducement methods are used. As cooling continues, additional nucleator particles desirably should separate out in a more or less continuous manner. These additional particles act as nucleators for continued wax crystallization, which in effect, would prevent substantial supercooling of the distillate. The advantages of having fresh nucleator particles formed continuously is that the supersaturation of the distillate with n-paraffins is kept at the lowest possible level thus facilitating a molecule of growth arrester to build itself into the growth center of growing crystals and by so doing to stop the further growth. The inhibitory effect of a growth arrester is believed to result from the presence of bulky groups in its molecule. Additional nucleator should separate out to replace the deactivated growth centers. The wax growth arrester is more soluble in said distillate than said nucleator and it acts as a growth arrester as the crystal forms.

The nucleator should not be insoluble in the distillate at elevated temperatures nor should it start to separate out at a temperature substantially above that at which wax crystallization can occur. If nucleators separate out at a temperature substantially above the temperature at which crystallization can occur, then they tend to settle at the bottom of the vessel holding the distillate, instead of remaining dispersed within the distillate. This factor is especially important when the distillate is subjected to repeated warming and cooling as during the warm and cool parts of a day since it does not result in adequate redispersion of the nucleant particles in the distillate.

The synthetic polymeric materials used as wax growth stimulators and wax growth arresters may be addition or condensation polymers or derivatized polymers. The two types of polymers may be derived from the same or different types of monomers and may be homopolymers or copolymers; e.g. derived from two or more monomers.

For the purpose of this invention, wax crystal growth stimulators, wax nucleators and nucleants for wax are all considered equivalent terms and are used interchangeably.

Wax growth arresters (hereinafter sometimes referred to as wax arresters), which generally are referred to as pour point depressants, are such chemical species which include in their molecular structure wax-like polymethylene segments which are capable of building themselves into the lattice of the wax crystals at the point of lattice dislocation, and also contain bulky groups which prevent incorporation of further molecules of n-paraffins at the point of lattice dislocation and by so doing stop further growth of crystal.

In a distillate fuel which has a tendency to become "wax-supersaturated", the combination of a nucleating agent and a growth arrester will be most effective. The nucleating agent will maintain a moderate rate of wax crystallization as the oil cools. As a consequence, the wax growth arrester becomes much more effective.

Experimental evidence bolstered by photomicrographs shows that under otherwise identical conditions, the crystalline structure of wax formed by the dual action effect of a wax arrester and a nucleating agent is characterized in that the size of the wax crystals is in the range of only a few microns.

A good synthetic polymeric wax nucleator, for example, can be chosen by comparing a transparent container with a 0.1 to 3.0 wt.% solution of the potential nucleator in a distillate to an identical container with the same distillate having no additive, as the temperature of the two materials is lowered. The onset of the wax crystallization from the distillate containing a polymeric material which has nucleator characteristics will occur at a higher temperature than that at which the crystallization will start in the absence of said nucleator. Similarly, a wax arrester usually is characterized by the ability to delay onset of crystallization; such delay is undesired.

It is theorized that the phenomena occurring within the oil can be explained as follows. Before wax crystals can form in any solution, such as an oil with wax dissolved therein, the solution must be supercooled (i.e. reach a temperature below the saturation point).

If the solution becomes highly supercooled before wax crystallization starts, the wax will crystallize at a very high rate once the crystallization sets in. Even if a wax arrester is present, it will generally be overwhelmed by the quantity of wax formed.

If a wax nucleator were put in the solution, growth of wax crystals would commence at a temperature just slightly below the saturation temperature. But with no wax arrester present, that growth may be just as detrimental since large wax crystals may be formed.

These flow improvers in order to be of real help when aplied to distillate fuels have to be effective in:

1. maintaining these fuels fluid at the operating temperatures,
2. arresting the growth of separating wax crystals when the oils are submitted to slow cooling, i.e. 0.2°F. to 2°F./hr., which are typical of the rates encountered when "oil in bulk" is exposed to atmospheric cooling,
3. arresting the growth of separating wax crystals when the oils are submitted to fast cooling, i.e. 10°F. to 100°F./hr., which are typical of the rates encountered when relatively warm oil enters the transfer lines and is there suddenly exposed to low temperatures.

All three above-quoted criteria are desired in order to assure that a wax-cloudy fuel is pumpable and filterable under the conditions of its distribution and its use.

The proper selection of laboratory tests which would predict the above factors, is of importance, in order to establish beforehand the suitability of an oil for the low temperature operation.

Over the years of laboratory and field experience, it has been found that the above-quoted three factors controlling the performance of wax-cloudy fuels, can be predicted by:

1. Fluidity — ASTM Pour Test, ASTM D97-66. This test is described in detail in ASTM Standards.
2. Wax Crystal Size at Slow Cooking Rates — Imperial Filterability Test (IFT). In this test a 200 ml sample of oil is cooled at a rate of 2°F./hr. from 10°F. above to 5°F. below its True Cloud Point at which temperature the oil is passed under reduced pressure through a filter element provided with a screen. The Imperial Filterability is reported in terms of the finest screen through which at least 90% of sample will pass under a suction of 12 inches of water in time not exceeding 25 seconds. The True Cloud Point employed in IFT as the reference point is the temperature at which the formation of wax crystals is first observed when a sample of oil is cooled under stirring at a rate of 20°F./hr.
3. Wax Crystal Size at Fast Cooling Rates — Cold Filter Plugging Point test (CFPP). This test is carried out by the procedure described in "Journal of the Institute of Petroleum", Volume 52, No. 510, June 1966, pp. 173–185. In brief, the CFPP test is carried out with a 45 ml. sample of the oil to be tested. The oil placed in the ASTM cloud point jar is cooled in a bath maintained at about −30°F. Every two degrees drop in temperature, starting from 4°F. above the cloud point, the oil is forced at a suction of 8 inches of water through a filter element provided with a 350 mesh screen into a pipette to a mark indicating a volume of 20 ml., at which time the oil is allowed to return by gravity flow to the cooling chamber. The test is repeated with each 2° drop in oil temperature until the oil fails to fill the pipette in a period of 60 seconds to the aforesaid mark. The results of the test are reported as the Cold Filter Plugging Point which is the highest temperature at which the oil fails to fill the pipette.

The preferred fuel oil compositions of this invention are middle distillate fuels having a boiling range anywhere in the range of 350°F.–700°F. (ASTM D86).

The synthetic polymers used as nucleating agents and as wax growth arresters are preferably both copolymers of ethylene with an unsaturated ester monomer; either the same or a different ester monomer may be used for the copolymer to be used as nucleator and that used as a growth arrester.

The preferred comonomer with the ethylene is a vinyl ester of $C_1$ to $C_{17}$, preferably $C_3$ to $C_7$, aliphatic, saturated, branched or unbranched, monocarboxylic acid, preferably a fatty acid. Other preferred monomers to be used with the ethylene include:

i. ethylenically unsaturated compounds of the formula:

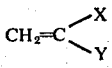

wherein X is H, halogen, or $C_1$–$C_7$ alkyl; Y is halogen or –COOR wherein R is hydrogen or $C_1$–$C_{16}$, preferably $C_2$–$C_8$, alkyl or aryl and ii. ethylenically unsaturated compounds of the formula:

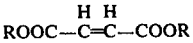

wherein R is $C_1$–$C_{16}$, preferably $C_2$–$C_8$, alkyl.

A $C_3$–$C_{30}$, preferably $C_3$–$C_8$, olefin hydrocarbon, preferably an alpha monoolefin, may also be used as comonomer.

All of the above-described monomers after incorporation in a suitable backbone can be partially or totally hydrolyzed to form hydroxy or carboxy containing polymers.

The synthetic polymers which may be used also include homopolymers of ethylene, halogenated polymers of ethylene, or halogenated copolymers of ethylene and $C_3$–$C_{30}$ olefins, preferably containing 2–40, more preferably 15–25 wt.% halogen (based on polymer), preferably chlorine, or a mixture of halogens, wherein the molecular weight ranges are similar to those described for ester derived polymers.

Typical vinyl esters include vinyl acetate, vinyl propionate, vinyl butyrate, vinyl caproate, vinyl caprylate, vinyl caprate.

Typical ethylenically unsaturated esters include methylacrylate, isobutylacrylate, laurylacrylate, $C_{13}$ oxoalkylmethacrylate.

When the comonomer is an ester of unsaturated diacid, it can include fumaric acid, maleic acid, monomethylfumarate, monobutylfumarate, monohexylmaleate, diisopropylmaleate, di-$C_{13}$ oxofumarate, dilauryl fumarate, diethylmethyl fumarate. Also useful are the copolymers of ethylene with maleic anhydride.

Specifically, for example, a relatively low molecular weight ethylene-vinyl ester copolymer with a relatively high vinyl ester content has been found to act as a wax growth arrester. On the other hand, a relatively high molecular weight copolymer of ethylene with a vinyl ester which copolymer has a relatively low content of vinyl ester acts as a nucleating agent. Even more specifically, blends containing ethylene/vinyl acetate copolymers of number average molecular weights from 1200-6000 (VPO) with vinyl acetate contents of about 28–50 wt.% (e.g. about 11 to 25 mole % ester) as the wax arresters and ethylene/vinyl acetate copolymers of about 500–10,000 (VPO) number average molecular weight with vinyl acetate comonomer proportions by weight of 1–30 wt.% (e.g. about 0.3 to 12 mole % ester) as the wax growth stimulators have been found to be highly effective. The number average molecular weight of the nucleant is preferably at least 500, preferably 1000, higher and/or the ester content at least 5% lower than the corresponding characteristics of the wax growth arrester.

All molecular weights specified herein are "number average molecular weights", which are molecular weights as measured by Vapor Phase Osmometry (VPO), e.g. using Mechrolab Vapor Phase Osmometer 301A.

All percents and all ratios herein are weight percents, or weight ratios, unless otherwise specified.

Thus, relative to the growth arrester, the nucleator can comprise an ethylene-vinyl acetate copolymer of a higher molecular weight if the vinyl acetate content of both polymeric materials is about equal, or of a lower vinyl acetate content if the molecular weight of both polymeric materials is about equal. The two types of synthetic polymers of the present invention may be made separately or they can be made consecutively in one batch by varying the reaction conditions. Thus, the reaction conditions can be selected so that the initial polymerization reaction produces a polymer having primarily nucleator characteristics and the reaction conditions can then be changed to produce a polymer having primarily wax growth arresting properties or vice versa. In this manner, a mixture of polymers can be produced having both types of functions. In the case of the ethylene/ester copolymers, the properties of the polymer as either wax growth stimulator or growth arrester can be varied by changing the composition, molecular weight or degree of ethylene branching of the copolymer, which ethylene branching is a function of polymerization temperature as pointed out in "Journal of Applied Polymer Science", Vol. 15, pp. 1737–1742 (1971).

In general, the preferred number average molecular weight (VPO) for the nucleator will be within the range of 500–30,000, more preferably 500–10,000, while that for the wax growth arrester will be within the range of 1200–20,000, more preferably 1200–6000.

In the specific embodiment of the invention which employs two different copolymers of ethylene and vinyl acetate the relationship between the concentration of vinyl acetate and molecular weight of the copolymers is important since it is the main factor which determines the role of the particular copolymer in the fuel. That is, it determines whether or not the copolymer as a whole will be performing within the composition as a wax arrester or as a wax nucleating agent. Thus, very generally as a rule of thumb, the nucleating agents should have relatively long polymethylene segments. Therefore, as these synthetic polymers approach low molecular weight ranges, the proportion of vinyl acetate should also decrease. On the other hand, as the molecular weight increases, the proportion of vinyl acetate should also increase. Thus, the specific wax nucleating agents will comprise a copolymer of ethylene and a relatively low proportion of vinyl acetate with a relatively high molecular weight.

The wax arrester on the other hand will, in general, be a relatively low molecular weight copolymer of a relatively high vinyl acetate content since the function of wax arresting depends more on the presence of bulky groups attached to the backbone of the molecule of the copolymer.

Although the separate copolymers may be blended directly in the fuel, it will normally be found desirable to prepare a concentrate. This may be effected by first associating each with a separate solvent, but most preferably by dissolving each in a common solvent. Thus, both the relatively lower molecular weight high vinyl acetate (second) copolymer and the first, the relatively high molecular weight low vinyl acetate copolymer, may be dissolved in a kerosene or heavy aromatic naphtha. Suitable concentrates will contain as active ingredients 5% to 95% first copolymer and 95% to 5% second copolymer (based on total weight of copolymer present). Preferred concentrates will contain 5–60%, preferably 10–50% total copolymer.

The arrester copolymers may be prepared by known procedures employing free-radical initiators, preferably organic peroxide compounds. Suitable procedures are described in some of the hereinbefore-identified U.S. specifications, such as U.S. Pat. Nos. 3,048,479 or 3,093,623.

Very generally, (especially for ethylene copolymers with vinyl acetate or other vinyl esters) polymerization temperatures of 70°C. to 200°C. and pressures of 500 to 10,000 psig, may be employed. While any free-radical initiator effective under such conditions may be used, it is preferred to employ dilauroyl peroxide or di-tert.-butyl peroxide.

The preparation of the stimulator copolymer is generally achieved in essentially the same manner. Reaction conditions are preferably so chosen as to result in a relatively high molecular weight and low vinyl acetate copolymer.

Suitably, there is present a total of 0.001% to 0.5% by weight of copolymers, based on the weight of fuel; preferably 0.005 to 0.1%, most preferably 0.01 to 0.04%, all percents being weight percents. The two polymeric materials may be used in ratios of 1–20, preferably 1–2, parts by weight of nucleator to 1–100, preferably 1–10, parts by weight of growth arrester; i.e. a preferred weight ratio of nucleator/growth arrester of 1/10 to 3/1. In the particular species of the invention represented by the Examples, it has been found that the growth arrester species and the nucleating agent seem to be most effective when from 5 to 35 wt.%, preferably 15 to 30 and most preferably about 25 wt.% of nucleating agent is used with growth arrester in the copolymer blend.

In preparing the preferred ethylene/vinyl ester copolymers, the polymerization of the ethylene and vinyl ester can be carried out as follows:

The solvent and a portion of the selected vinyl ester, e.g. 0–50 wt.%, preferably 10 to 30 wt.% of the total amount of unsaturated ester used in the batch, are charged to a stainless steel pressure vessel which is equipped with a stirrer and a heating and cooling coil. The reactor contents are then brought to the desired reaction temperature, e.g., 70°–200°C., and pressured to the desired pressure, 500–10,000 psig., with ethylene. Then initiator, preferably dissolved in solvent, and additional amounts of unsaturated ester are added to the vessel continuously, or at least periodically, during the reaction time, e.g., 1–10 hours, which continuous addition gives a more homogeneous copolymer as compared to adding all the unsaturated ester and the peroxide at intervals during the reaction.

Also during this reaction time, as ethylene is consumed in the polymerization reaction, additional ethylene is supplied through a pressure-controlling regulator so as to maintain the desired reaction pressure fairly constant at all times. Following the completion of the reaction, the liquid product is discharged and the solvent and other volatile constituents are distilled off, leaving the polymer as residue.

Usually based upon 100 parts by weight of the ester copolymer to be produced, about 100 to 600 parts by weight of solvent, and about 1 to 20 parts by weight of a free radical initiator will be used to initiate the reaction.

The solvent can be any nonreactive organic solvent for furnishing a liquid phase reaction medium which will not react with the initiator or otherwise interfere with the reaction, and preferably is a hydrocarbon solvent such as benzene or cyclohexane, or a nonhydrocarbon type solvent such as t-butyl alcohol.

Free radical initiators that can be used include alkyl peroxides of $C_2$ to $C_{18}$, branched or unbranched, carboxylic peracids such as di-acetyl peroxide, di-propionyl peroxide, dipelargonyl peroxide or di-lauroyl peroxide. Other free radical initiators that can be used include ditert-butyl peroxide, benzoyl peroxide, various azo initiators such as azodiisobutyronitrile and azobis-2-ethylvaleronitrile.

The ethylene-unsaturated ester polymers of this invention are prepared in a manner similar to the ethylenevinyl acetate copolymerization described above. Additional preparation methods are adequately described in the literature and may be found, for example, in U.S. Pat. Nos. 2,327,705; 3,048,479; 3,087,894; 3,093,623; 3,126,364; 3,165,485 and Canadian Pat. No. 676,875.

EXAMPLE 1

An ethylene/vinyl acetate copolymer was prepared in benzene containing initially (calculated on benzene) 0.7 wt.% di-t-butyl peroxide as initiator, 4.3 wt.% vinyl acetate and 0.6 wt.% acetone, at a pressure of about 1100 psig, a temperature of about 285°F. and a batch time of about three hours. During the 3 hours reaction period, calculated on benzene, an additional amount of 10% vinyl acetate and 1.2% peroxide were injected into the reactor. The resulting copolymer had a vinyl acetate content of about 16 wt.% and a molecular weight of about 2600 (VPO). The material had a specific viscosity measured in 1 wt.% solution in toluene at 100°F. of about 0.2. This copolymer is further referred to as Copolymer A.

A copolymer of ethylene and vinyl acetate was similarly prepared except that cyclohexane was used as solvent and dilauroyl peroxide as an initiator. The temperature was 220°F. and the pressure was 1050 psig. It had a vinyl acetate content of 38 wt.% and a number average molecular weight of approximately 1800 as measured by vapor phase osmometry (VPO) and a specific viscosity under the same conditions as Copolymer A of 0.13. This polymer was labeled Copolymer B; it has pour point depressing abilities in the middle distillate fuels of the invention.

A copolymer was prepared according to the detailed procedure described above except that the copolymerization was carried out at 900 psig ethylene pressure and 300°F. temperature over a period of 6 hours and there was no vinyl acetate present initially in the benzene. Over the reaction period, calculated on the basis of benzene, a total of 12 wt.% vinyl acetate and 1.1 wt.% of the di-t-butyl peroxide were injected into the reactor. This copolymer is referred to herein as Copolymer H; it has a molecular weight of 3000 and a vinyl acetate content of 16%.

Copolymers A and H, which were synthesized to be used as a nucleating agent (growth stimulant) and various other growth stimulants, prepared in a way similar to that used to make Copolymer A, were blended with Copolymer B (a wax growth arrester) in three typical commercial middle distillates, designated "X", "Y" and "Z", and tested for their potency; the results being tabulated in Table I below.

TABLE I

THE POTENCY OF WAX CRYSTAL MODIFIERS

| | Physico-Chemical Characteristic of the Copolymers | | | Filterability Improvement | | | | | |
|---|---|---|---|---|---|---|---|---|---|
| | | | | Fuel Z[2] | | Fuel Y[3] | | Fuel X[3] | |
| Copolymer | V.A., wt.% | Mol. Wt. | Spec. Visc. | IFT[4] Mesh | CFPP, °F[5] | IFT[6] Mesh | CFPP, °F[6] | IFT[7] Mesh | CFPP, °F[7] |
| None | — | — | — | <20 | 10 | 30 | 28 | 30 | 30 |
| Growth Arrester | | | | | | | | | |
| Copolymer B | 38 | 1800 | 0.13 | 40 | 10 | 40 | 27 | 30 | 26 |
| Growth Stimulant[1] | | | | | | | | | |
| Copolymer G | 14 | 2700 | 0.14 | — | — | 100 | 1 | — | — |
| Copolymer A | 16 | 2600 | 0.20 | — | — | 80 | 2 | 80 | 18 |
| Copolymer H | 16 | 3000 | 0.24 | 80 | −18 | — | — | — | — |
| Copolymer C | 19 | 2900 | 0.24 | 80 | −14 | — | — | — | — |
| Copolymer D | 23 | 4300 | 0.46 | 100+ | 6 | — | — | — | — |
| Copolymer E | 28 | 5400 | 0.49 | 100+ | 8 | — | — | — | — |
| Copolymer F | 29 | 6000 | — | 40 | −18 | — | — | — | — |

TABLE I-continued

THE POTENCY OF WAX CRYSTAL MODIFIERS

| Copolymer | Physico-Chemical Characteristic of the Copolymers V.A., wt.% | Mol. Wt. | Spec. Visc. | Filterability Improvement Fuel Z[2] IFT[4] Mesh | CFPP, °F[5] | Fuel Y[3] IFT[6] Mesh | CFPP, °F[6] | Fuel X[3] IFT[7] Mesh | CFPP, °F[7] |
|---|---|---|---|---|---|---|---|---|---|
| Copolymer K | 9 | 4100 | 0.37 | — | — | — | −2 | 270 | 3 |

[1]For potency measurement used in a blend of 1 part growth stimulant copolymer with 3 parts of Copolymer B.
[2]Derived from mixed crude oil.
[3]Derived from paraffinic crude oil.
[4]0.015 % Additive.
[5]0.02% Additive.
[6]0.1% Additive.
[7]0.01% Additive.

EXAMPLE 2

Additional potency tests were carried out on a series of other blends as shown in the following Table II.

TABLE II

EFFECT OF ETHYLENE/VINYL ACETATE CO-ADDITIVE ON POTENCY
Ceuta Fuel
ASTM Cloud = +16°F.

| % Treat | 0.02 | 0.015 |
|---|---|---|
| Additive | CFPP, °F. | IFT No.[1] |
| None | 10 | below 20 |
| Copolymer B | 10 | 53 |
| 75/25 Copolymer B/Copolymer H | −15 | 89 |
| 75/25 Copolymer B/Copolymer F | −18 | 51 |
| 50/50 Copolymer B/Copolymer H | −18 | 54 |
| 50/50 Copolymer B/Copolymer F | −6 | 36 |
| Copolymer H | 6 | 34 |
| Copolymer F | 10 | 24 |

[1]Apparent mesh size passed; these values were obtained by interpolation between standard screen sizes.

As can be seen above, when the growth arresters or growth stimulators were used individually, the performance of the base fuel in the CFPP test was only marginally improved with Copolymer H and no improvement was obtained with the other two copolymers. Copolymer B (arrester) gave a moderate improvement in the IFT test. The stimulators were of little effect. In contrast, the copolymers B and H used in a 3 to 1 ratio gave a dramatic improvement amounting to 28°F. depression of CFPP and IFT improvement from less than 20 apparent mesh of the base oil to 89 apparent mesh for the treated oil.

EXAMPLE 3

A blend of Copolymer H with Copolymer B was compared with a similar blend of Copolymer F and Copolymer B in middle distillate fuel oils. The results are illustrated below in Table III.

TABLE III

| Oil | Flow Improver % | Base Oil | Blend 1[a] | Blend 2[b] | Copolymer B |
|---|---|---|---|---|---|
| | | | IFT Mesh Passed | | |
| Fuel T | 0.025 | — | 270 | 100 | 270 |
| Fuel R | 0.025 | — | 270 | 270 | 100 |
| Fuel Y | 0.1 | — | 100 | 30 | 40 |
| | | | CFPP°F. | | |
| Fuel S | 0.025 | 22 | 4 | 10 | 20 |
| Fuel T | 0.025 | 14 | 0 | 6 | 12 |
| Fuel R | 0.025 | 16 | −4 | −6 | 14 |
| Fuel Y | 0.1 | 30 | 6 | 4 | 22 |

[a]45% solution in heavy aromatic naphtha of 25% Copolymer H + 75% Copolymer B
[b]45% solution in heavy aromatic naphtha of 33% Copolymer F + 67% Copolymer B.

EXAMPLE 4

To minimize the handling problems, these additives are used commercially in the form of a concentrated solution in a petroleum solvent. The viscosity in centistokes of the resultant compositions was determined and the results summarized below in Table IV.

TABLE IV

FLOW AND HANDLING PROPERTIES OF CO-ADDITIVE BLEND

| | Viscosity Cs 100°F. | 210°F. |
|---|---|---|
| 22.5% Copolymer B<br>22.5% Copolymer H<br>55.0% Kerosene | 169 | 27 |
| 22.5% Copolymer B<br>22.5% Copolymer F<br>55.0% Kerosene | No flow | 282 |
| 31.5% Copolymer B<br>13.5% Copolymer H<br>55.0% Kerosene | 131 | 24 |
| 31.5% Copolymer B<br>13.5% Copolymer F<br>55.0% Kerosene | No flow | 87 |
| | Viscosity at 100°F., Cs | ASTM Pour °F. |
| 22.5% Copolymer B<br>12.5% Copolymer F<br>65.0% Heavy Aromatic Naphtha | 349.5 | 60 |
| 33.5% Copolymer B<br>11.5% Copolymer H<br>55.0% Heavy Aromatic Naphtha | 106.3 | 25 |

As can be seen from the above Table IV, it is of significant practical advantage to use a low molecular weight stimulator. This saves the user the expense and inconvenience of having special heating facilities which would be required when employing a high molecular weight stimulator.

EXAMPLE 5

The effect of the nucleant and wax arrester combination on the start of crystallization in degrees Centigrade as measured by Differential Scanning Calorimetry (DSC) is illustrated in the following Table V; the tests being carried out using a cooling rate of 10°C./minute.

TABLE V

| Fuel | Start of Wax Crystallization from Fuel X, °C. |
|---|---|
| Fuel X (No additives) | −7.5 |
| Fuel + 0.02% Copolymer B (wax arrester) | −8.5 |
| Fuel + 0.02% (75 Copolymer B/25 Copolymer A) | −7.0 |
| Fuel + 0.02% (75 Copolymer B/25 Copolymer K) | −5.0 |

The above data shows that the wax arrester lowers the temperature of the onset of crystallization of the n-paraffins from the base fuel while the combination of the nucleant and the wax arrester in accordance with the present inventon facilitates crystallization at a higher temperature. Copolymer B, the wax growth arrester, is an effective pour point depressant for distillate fuels.

EXAMPLE 6

A chlorinated ethylene polymer L having a number average molecular weight of about 3500 (VPO) and containing 20 wt.% chlorine was evaluated as wax growth arrester in the following Table VI wherein the fuel is Fuel X and the additives are used in a total concentration of 0.02 wt.% based on the fuel, with the additive blend ratios in parts by weight.

TABLE VI

| Fuel | CFPP in °C. |
|---|---|
| Fuel X | −1 |
| Copolymer B | −3 |
| 3/1 Copolymer B/Copolymer A | −8 |
| 2/1 Polymer L/Copolymer K | −16 |

The composition of the instant invention is found to be compatible with other additive materials and may be blended successfully with distillate oils containing minor amounts of viscosity index improvers, other pour depressants, rust inhibitors, antioxidants, sludge inhibitors, sludge dispersants, etc.

What we claim is:

1. A fuel oil composition comprising a major proportion of a middle distillate fuel oil containing n-paraffin wax which crystallizes from said oil during cooling, and in the range of about 0.005 to 0.1 wt.% of a synergistic flow improving combination comprising:

a. a wax nucleator which raises the temperature at which the onset of wax crystallization from said fuel oil occurs during cooling, said nucleator being soluble in said oil at temperatures substantially above the saturation temperature of said wax in said oil but which begins to separate out from the oil as the oil is cooled towards said saturation temperature, and b. a wax growth arrester which when added to said fuel oil lowers the temperature at which wax begins to crystallize from said oil during cooling, said growth arrester being a pour point depressant, both of said (a) and (b) being separately prepared synthetic polymers which are copolymers consisting essentially of ethylene with an ethylenically unsaturated ester selected from the group consisting of vinyl acetate, vinyl ester of a $C_3$ to $C_7$ saturated fatty acid, and compounds of the formula:

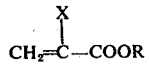

wherein: X is selected from the group consisting of hydrogen and $C_2$ to $C_7$ alkyl groups, and R is a $C_2$ to $C_8$ alkyl group;

said (a) synthetic polymer having a number average molecular weight (VPO) in the range of 500 to 10,000 and containing in the range of 0.3 to 12 mole % of said unsaturated ester;

said (b) synthetic polymer having a number average molecular weight (VPO) in the range of 1,200 to 20,000;

said (a) and (b) synthetic polymers being present in a relative weight ratio of 1 to 20 parts of (a) synthetic polymer per 1 to 100 parts of (b) synthetic polymer;

said (a) and (b) synthetic polymers differing from each other in at least one of the following characteristics: specific unsaturated ester monomer utilized in the polymer, amount of ethylene present relative to the respective comonomer, the amount of branching, and molecular weight;

and wherein, when both of said (a) and (b) synthetic polymers are copolymers of ethylene and a vinyl ester, the vinyl ester content of (a) synthetic polymer is at least 5 weight % lower than the vinyl ester content of the (b) synthetic polymer.

2. The fuel composition of claim 1, wherein the (b) synthetic polymer has a number average molecular weight within the range of 1,200–6,000 (VPO), and contains in the range of about 11 to about 25 mole % of said unsaturated ester.

3. The fuel composition of claim 2, wherein at least one of said (a) and (b) synthetic polymers is a copolymer of ethylene and vinyl acetate.

4. The fuel composition of claim 3, wherein said (a) synthetic polymer consists essentially of ethylene and in the range of 1 to 30 weight % vinyl acetate, and said (b) synthetic polymer consists essentially of ethylene and 28 to 40 weight % vinyl acetate.

5. The fuel composition of claim 1, wherein said (b) synthetic polymer is a copolymer of ethylene and isobutyl acrylate.

6. The fuel composition of claim 1, wherein both said (a) synthetic polymer and said (b) synthetic polymer are each a copolymer of ethylene and vinyl acetate.

7. A fuel oil comprising a major proportion of a middle distillate fuel oil containing n-paraffin wax which crystallizes from said oil during cooling, said fuel oil being improved in its low temperature flow and filterability by the incorporation of about 0.001 to 0.5 weight % of an oil-soluble flow and filterability improver composition comprising:

(a) 1 to 20 parts by weight of a first synthetic polymer having the property of a wax nucleator in said oil which raises the temperature at which the onset of wax crystallization from said oil occurs during cooling, said nucleator being soluble in said oil at temperatures substantially above the saturation temperature of said wax in said oil, but which begins to crystallize from the oil as the oil is cooled towards said saturation temperature, said synthetic polymer comprising a copolymer of a major amount by weight of ethylene and in the range of about 1 to 30 weight % vinyl acetate, said copolymer having a number average molecular weight (VPO) in the range of 500 to 10,000; and (b) 1 to 100 parts by weight of a second, and separately prepared, synthetic polymer having the property of a wax growth arresting function in said distillate which when added to said fuel oil lowers the temperature at which wax begins to crystallize from said oil during cooling, said second synthetic polymer comprising a copolymer of a major amount by weight of ethylene and in the range of about 28 to 50 weight % vinyl acetate, and having a number average molecular weight in the range of about 1,200 to 6,000 (VPO);

and wherein the vinyl acetate content of said first synthetic polymer is at least 5 weight % lower than that of said second synthetic polymer.

8. A concentrate, suitable for improving the cold flow properties of fuel oil comprising a major proportion of a middle distillate fuel oil, containing n-paraffin wax which crystallizes from said fuel oil during cooling, said concentrate containing a diluent and 5 to 60 weight % of a mixture of:

a. a first synthetic polymer which is capable of raising the temperataure of the onset of wax crystallization of a wax containing middle distillate fuel; and b. a second synthetic polymer, which lowers the temperature at which wax begins to crystallize from a wax-containing middle distillate fuel oil and which has the ability to arrest the growth of wax crystals separating from said wax-containing middle distillate fuel oil;

both of said (a) and (b) being separately prepared synthetic polymers which are copolymers consisting essentially of ethylene with an ethylenically unsaturated ester selected from the group consisting of vinyl acetate, vinyl ester of a $C_3$ to $C_7$ saturated fatty acid, and compounds of the formula:

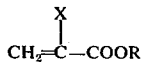

wherein: X is selected from the group consisting of hydrogen and $C_1$ to $C_7$ alkyl groups, and R is a $C_1$ to $C_8$ alkyl group;

said (a) synthetic polymer having a number average molecular weight (VPO) in the range of 500 to 10,000 and containing in the range of 0.3 to 12 mole % of said unsaturated ester;

said (b) synthetic polymer having a number average molecular weight (VPO) in the range of 1,200 to 20,000;

said (a) and (b) synthetic polymers being present in a relative weight ratio of 1 to 20 parts of (a) synthetic polymer per 1 to 100 parts of (b) synthetic polymer;

said (a) and (b) synthetic polymers differing from each other in at least one of the following characteristics: specific unsaturated ester monomer utilized in the polymer, amount of ethylene present relative to the respective comonomer, the amount of branching, and molecular weight;

and wherein, when both of said (a) and (b) synthetic polymers are copolymers of ethylene and a vinyl ester, the vinyl ester content of (a) synthetic polymer is at least 5 weight % lower than the vinyl ester content of the (b) synthetic polymer.

9. The concentrate of claim 8, wherein both of said synthetic polymers (a) and (b) are copolymers of ethylene with vinyl acetate.

10. An additive concentrate useful for treatment of waxy distillate fuel oils to improve their flow and filterability at low temperatures, comprising a diluent oil, and 5 to 60 weight % of a mixture of:

1. a first copolymer consisting essentially of ethylene and 1 to 30 weight % vinyl acetate, said first copolymer having a number average molecular weight (VPO) up to 10,000; and
2. a second copolymer consisting essentially of ethylene and 28 to 50 weight percent vinyl acetate, said second copolymer having a number average molecular weight (VPO) in the range of 1,200 to 6,000, and being separately prepared;

and wherein said first copolymer has a molecular weight at least 500 higher and a vinyl acetate content at least 5 weight % lower than said second copolymer, and the weight ratio of said first copolymer to said second copolymer is in the range of 1 to 10 to 3 to 1.

11. A fuel oil comprising a major proportion of middle distillate fuel oil containing n-paraffin wax improved in its flow and filterability at low temperature by incorporation of 0.005 to 0.1 weight % of a synergistic flow improving combination of a mixture of:

1. a first copolymer consisting essentially of ethylene and 1 to 30 weight % vinyl acetate, said first copolymer having a number average molecular weight (VPO) up to 10,000; and
2. a second copolymer consisting essentially of ethylene and 28 to 50 weight % vinyl acetate, said second copolymer having a number average molecular weight (VPO) in the range of 1,200 to 6,000, and being separately prepared;

and wherein said first copolymer has a molecular weight at least 500 higher and a vinyl acetate content at least 5 weight % lower than said second copolymer, and the weight ratio of said first copolymer to said second copolymer is in the range of 1 to 10 to 3 to 1.

* * * * *

UNITED STATES PATENT OFFICE

CERTIFICATE OF CORRECTION

Patent No. 3,961,916 Dated June 8, 1976

Inventor(s) Stephen Ilnyckyj and Charles O. Cole

It is certified that error appears in the above-identified patent and that said Letters Patent are hereby corrected as shown below:

Column 11, line 63, after "and" cancel "$C_2$" and substitute --$C_1$--.

Same line, after "a" cancel "$C_2$" and substitute --$C_1$--.

Signed and Sealed this

*Twenty-second* Day of *November 1977*

[SEAL]

*Attest:*

RUTH C. MASON
*Attesting Officer*

LUTRELLE F. PARKER
*Acting Commissioner of Patents and Trademarks*